US012616288B2

(12) United States Patent
Hwang

(10) Patent No.: US 12,616,288 B2
(45) Date of Patent: May 5, 2026

(54) COSMETIC REFILL CONTAINER AND COSMETIC CONTAINER HAVING THE SAME

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 162 days.

(21) Appl. No.: 18/510,449

(22) Filed: Nov. 15, 2023

(65) Prior Publication Data

US 2024/0172857 A1 May 30, 2024

(30) Foreign Application Priority Data

Nov. 28, 2022 (KR) ..... 10-2022-0161318
Oct. 26, 2023 (KR) ..... 10-2023-0144628

(51) Int. Cl.
*A45D 34/00* (2006.01)

(52) U.S. Cl.
CPC ..... *A45D 34/00* (2013.01); *A45D 2200/05* (2013.01)

(58) Field of Classification Search
CPC ..... A45D 34/00; A45D 2200/05; A45D 2034/005; B05B 11/1026; B05B 11/1015; B05B 11/1047; B05B 11/1004
See application file for complete search history.

(56) References Cited

U.S. PATENT DOCUMENTS 9,370,233 B2 * 6/2016 Jung ..... B05B 11/1026
11,700,928 B2 * 7/2023 Zheng ..... B05B 11/1046 222/153.09
2020/0017272 A1 * 1/2020 Okude ..... B65D 21/086
2021/0000240 A1 * 1/2021 Lee ..... B05B 11/0054

FOREIGN PATENT DOCUMENTS

KR 10-1261813 A 5/2013
KR 10-2021-0005426 A 1/2021
KR 10-2021-0115707 A 9/2021

* cited by examiner

*Primary Examiner* — Vishal Pancholi
(74) *Attorney, Agent, or Firm* — Heedong Chae; Lucem, PC

(57) ABSTRACT

A cosmetic refill container having an air block structure and a cosmetic container having the cosmetic refill container are disclosed. The cosmetic refill container having an air block structure of the present disclosure includes: a refill container main body configured to store a cosmetic preparation therein and coupled to a container main body; a sealing coupling unit coupled to the refill container main body and provided as a discharge passage of the cosmetic preparation stored in the refill container main body; anda sealing member coupled to the sealing coupling unit and configured to prevent contact between the cosmetic preparation stored in the refill container main body and external air.
Since this embodiment applies an air block structure, when the refill container is replaced, refilling is possible without contact between a cosmetic preparation and air, so it is possible to prevent rancidity or contamination of the cosmetic preparation.

14 Claims, 7 Drawing Sheets

COSMETIC REFILL CONTAINER AND COSMETIC CONTAINER HAVING THE SAME

CROSS REFERENCE TO RELATED APPLICATION

The present application claims priority to Korean Patent Applications Nos. 10-2022-0161318, filed Nov. 28, 2022 and 10-2023-0144628, filed Oct. 26, 2023 the entire contents of which are incorporated herein for all purposes by this reference.

BACKGROUND

Technical Field

The present disclosure relates to a cosmetic container and, in more detail, a cosmetic refill container having an air block structure that can be refilled with a cosmetic preparation without contact with air by employing an air block structure, and a cosmetic container having the cosmetic refill container.

Description of the Related Art

In general, as a method of using a liquid-state cosmetic preparation such as cosmetics that it is preferable to use by a small amount and an accurate amount at a time including eye cream, a method of individually packaging preparations in capsules, etc., by the amount to be used at each time of use has been used in the related art.

However, such an individual packaging method has a problem of inefficiency because even after a user uses a preparation, a relatively large amount of cosmetic preparation remains in a capsule.

In order to overcome the problem of such an individual packaging method, a configuration designed for a user to take out and use a cosmetic preparation every time the user uses the preparation using a taking-out instrument such as a common pipette or syringe or a taking-out instrument having the configuration of a push pump after the preparation is put into a container has been disclosed.

Meanwhile, the cosmetic preparation stored in a refill container is generally directly exposed to the air when a cosmetic container is refilled. That is, when the cap of a refill container is opened in the process of replacing a refill container, the cosmetic preparation stored in the refill container comes in contact with the air, and from this moment, the cosmetic preparation starts becoming rancid or is contaminated and the lifespan shortens, so there is a need for measures for solving this problem.

The above description is the background for helping understand the present disclosure and does not means the related art well known in the art.

SUMMARY

Accordingly, an objective of the present disclosure is to provide a cosmetic refill container having an air block structure that can be refilled with a cosmetic preparation without contact with air by employing an air block structure, and a cosmetic container having the cosmetic refill container.

According to an aspect of the present disclosure, there may be provided a cosmetic refill container that includes: a refill container main body configured to store a cosmetic preparation therein and coupled to a container main body; a sealing coupling unit coupled to the refill container main body and provided as a discharge passage of the cosmetic preparation stored in the refill container main body; and a sealing member coupled to the sealing coupling unit and configured to prevent contact between the cosmetic preparation stored in the refill container main body and external air.

The sealing coupling unit may include: a first body coupled to a head of the refill container main body; and a second body formed at a lower portion of the first body and having the sealing member coupled thereto.

The sealing coupling unit may further include a supporting step formed on an inner wall of a joint area between the first body and the second body and locking and supporting a housing of a pumping unit coupled to the container main body.

The sealing member may include: a sealing body coupled to a body hole formed at the sealing coupling unit; a sealing flange formed at the sealing body and configured to cover an area over the body hole; and a sealing expansion formed at the sealing body to protrude under the body hole and configured to prevent separation of the sealing body.

A supporting protrusion may be formed on a bottom inside the second body of the sealing coupling unit and a bottom of the sealing flange is supported on the supporting protrusion.

The refill container main body may include a refill container body having the sealing coupling unit coupled thereto and a body expansion configured to support a bottom of the container main body may be formed at the refill container main body.

The refill container main body may further include a refill cap detachably coupled to the refill container body and the refill cap may be coupled to the refill container body with the sealing coupling unit coupled to the refill container body.

The refill container main body may further include a refill container piston disposed in the refill container body and configured to guide discharge of the cosmetic preparation.

Further, according to another aspect of the present disclosure, there may be provided a cosmetic container that includes: a container main body; a refill container coupled to the container main body and configured to store a cosmetic preparation; and a pumping unit coupled to the container main body and configured to pump the cosmetic preparation stored in the refill container to the outside of the refill container, wherein the refill container includes: a refill container main body coupled to the container main body; a sealing coupling unit coupled to the refill container main body and provided as a discharge passage of the cosmetic preparation stored in the refill container main body; and a sealing member coupled to the sealing coupling unit and configured to prevent contact between the cosmetic preparation stored in the refill container main body and external air.

Since the embodiments of the present disclosure apply an air block structure, when the refill container is replaced, refilling is possible without contact between a cosmetic preparation and air, so it is possible to prevent rancidity or contamination of the cosmetic preparation.

BRIEF DESCRIPTION OF THE DRAWINGS

The above and other objectives, features and other advantages of the present disclosure will be more clearly understood from the following detailed description when taken in conjunction with the accompanying drawings, in which.

DETAILED DESCRIPTION

Figure 1:
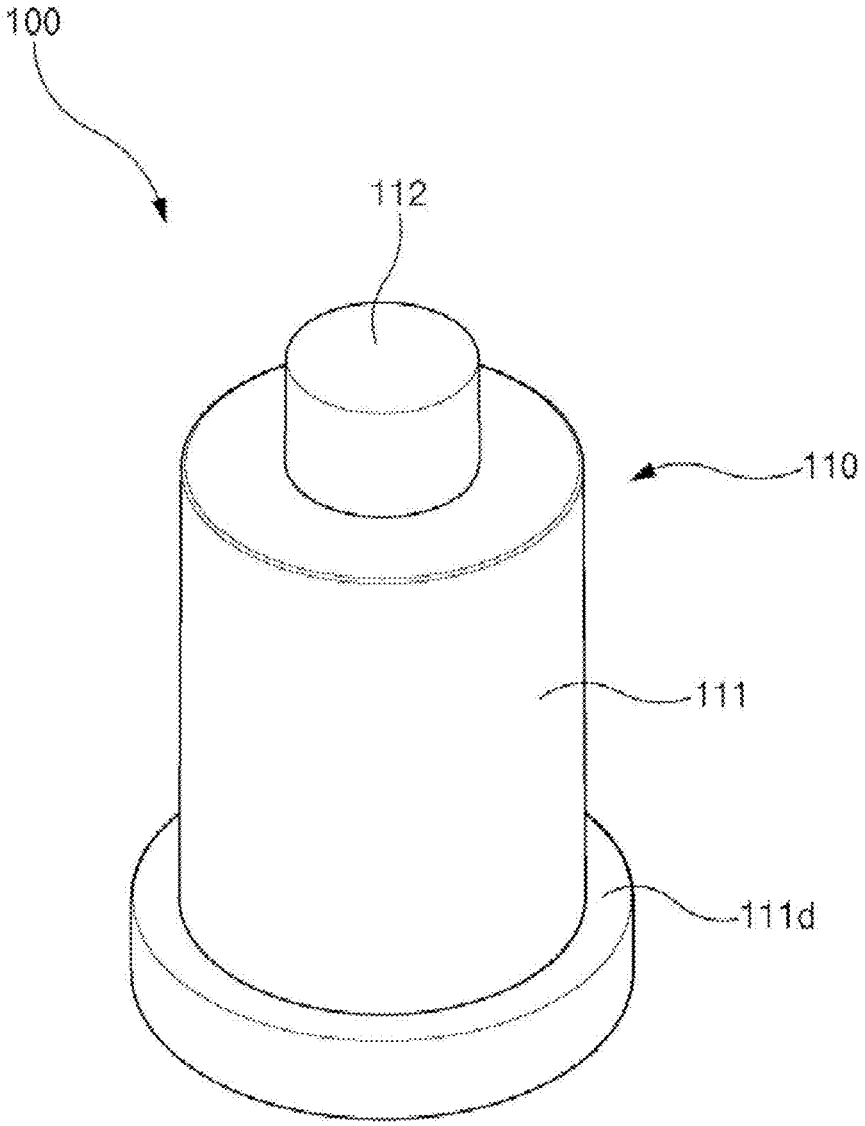
FIG. 1 is a perspective view schematically showing a cosmetic refill container having an air block structure according to an embodiment of the present disclosure.

It is required to refer to the accompanying drawings exemplifying preferred embodiments of the present disclosure and the contents in the accompanying drawings to help sufficiently understand the present disclosure, the operational advantages of the present disclosure, and the objectives that are achieved by implementing the present disclosure.

The present disclosure will be described hereafter in detail by describing exemplary embodiments of the present disclosure with reference to the accompanying drawings. Like reference numerals given in the drawings indicate like components.

Figure 2:
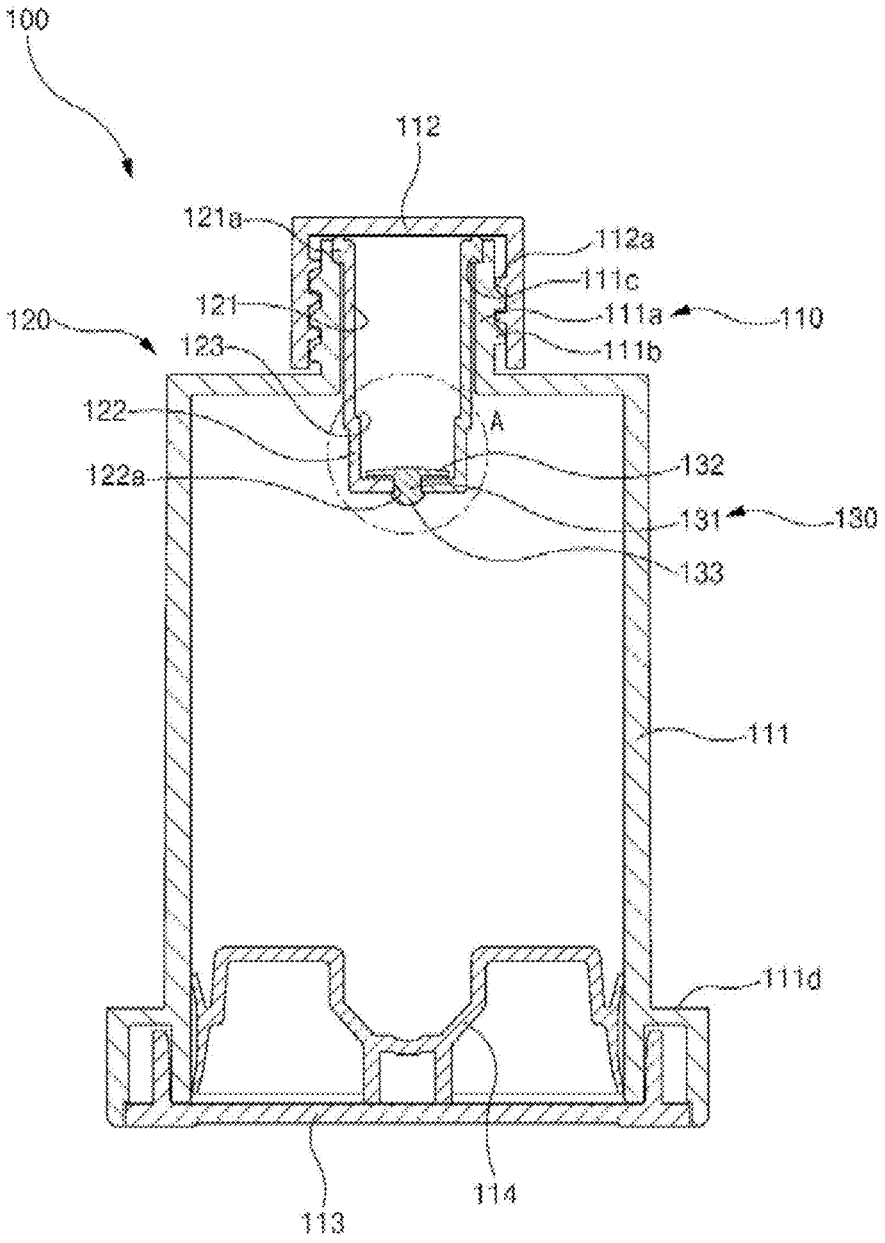
FIG. 2 is a cross-sectional view of FIG. 1.
Figure 3:
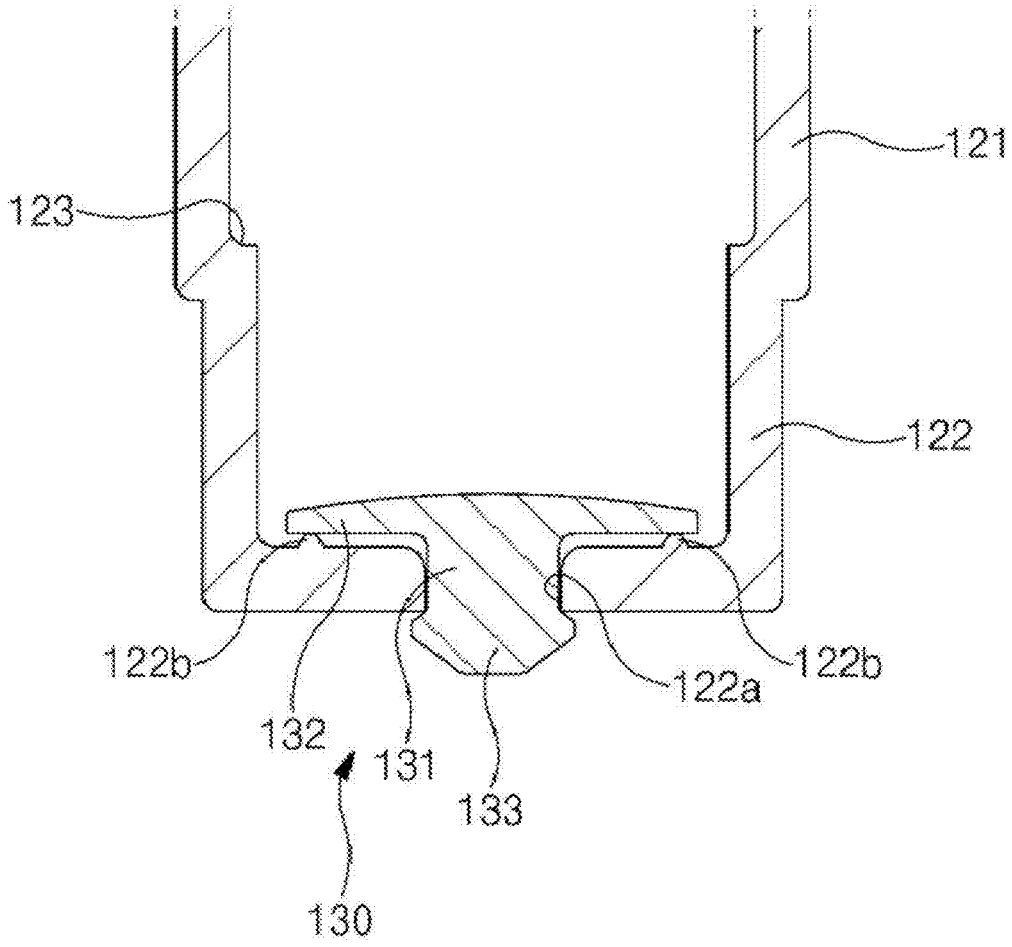
FIG. 3 is an enlarged view of the area "A" shown in FIG. 2.
Figure 4A:
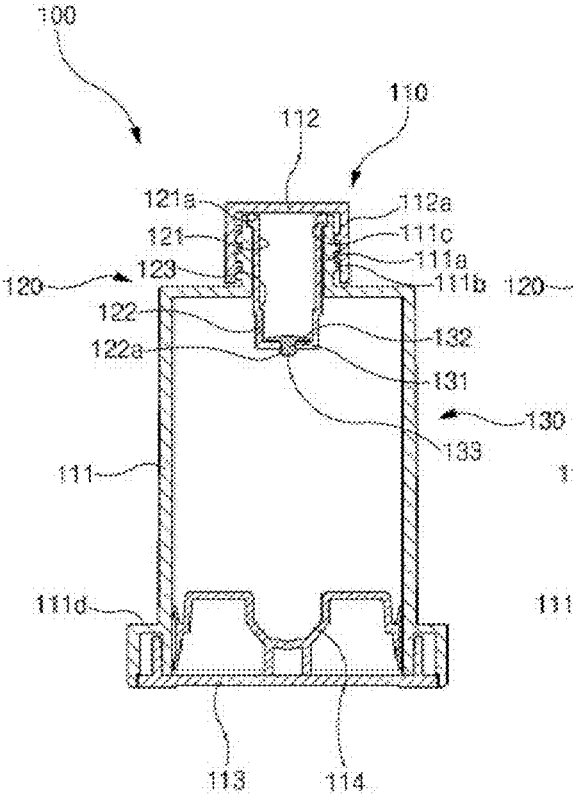
FIGS. 4A and 4B are views showing that a refill cap of the cosmetic refill container shown in FIG. 2 is separated from a refill container body.
Figure 4B:
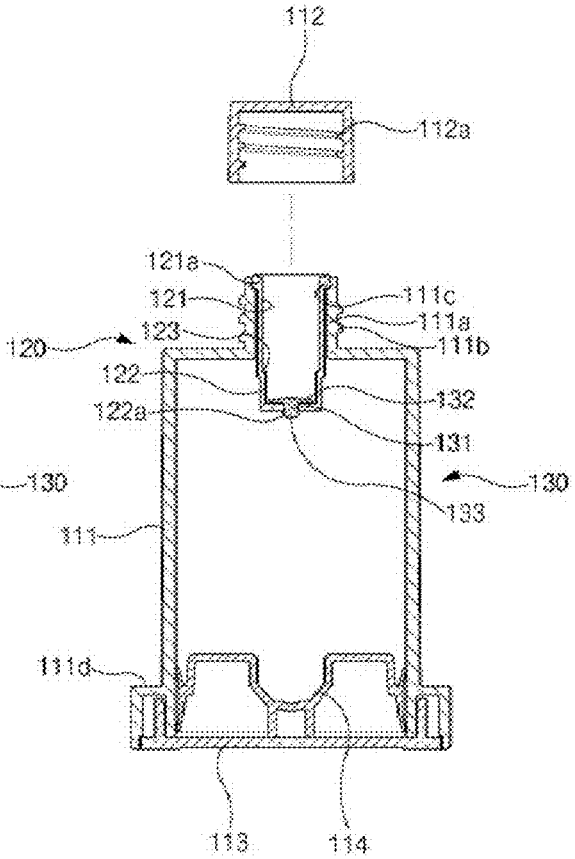
Figure 5:
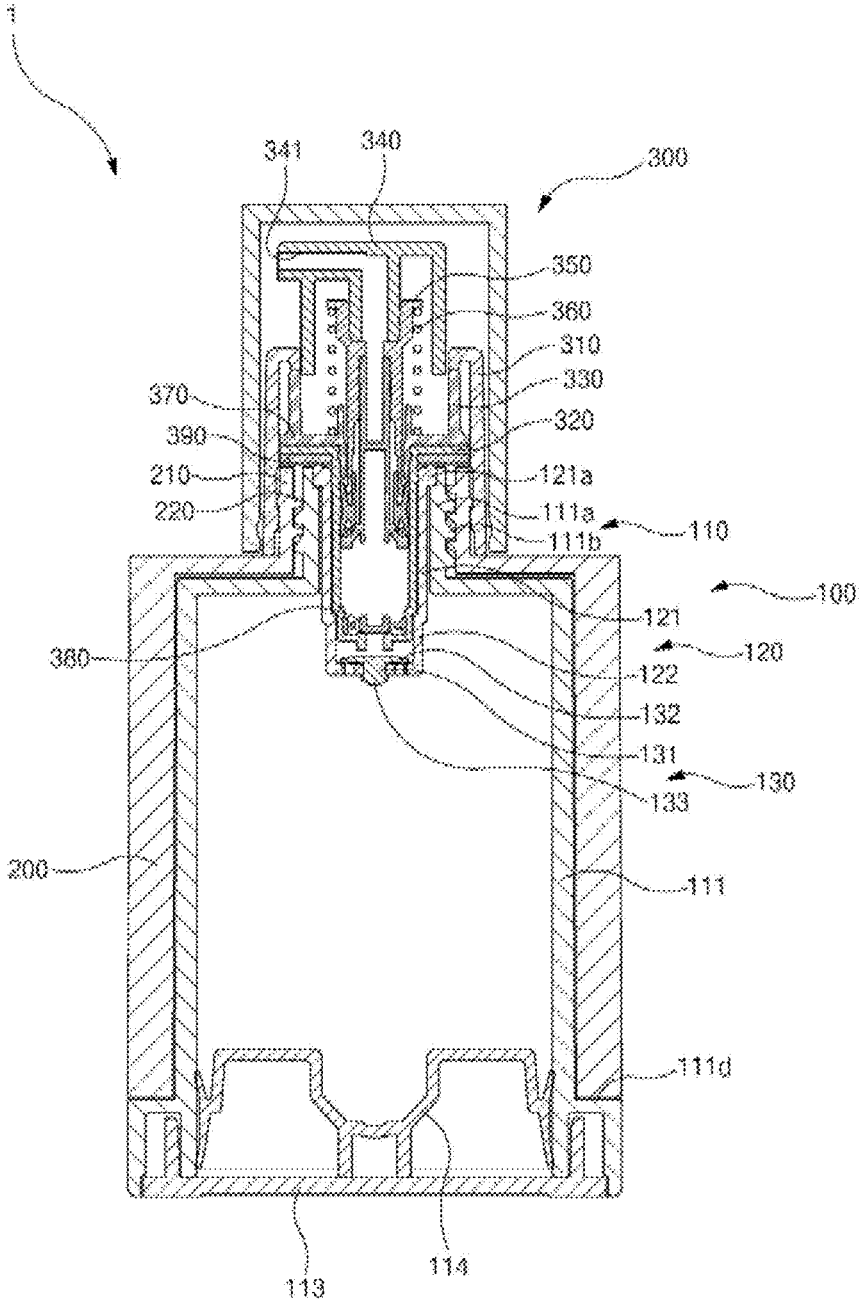
FIG. 5 is a cross-sectional view showing a cosmetic container coupled with the cosmetic refill container shown in FIG. 1.
Figure 6:
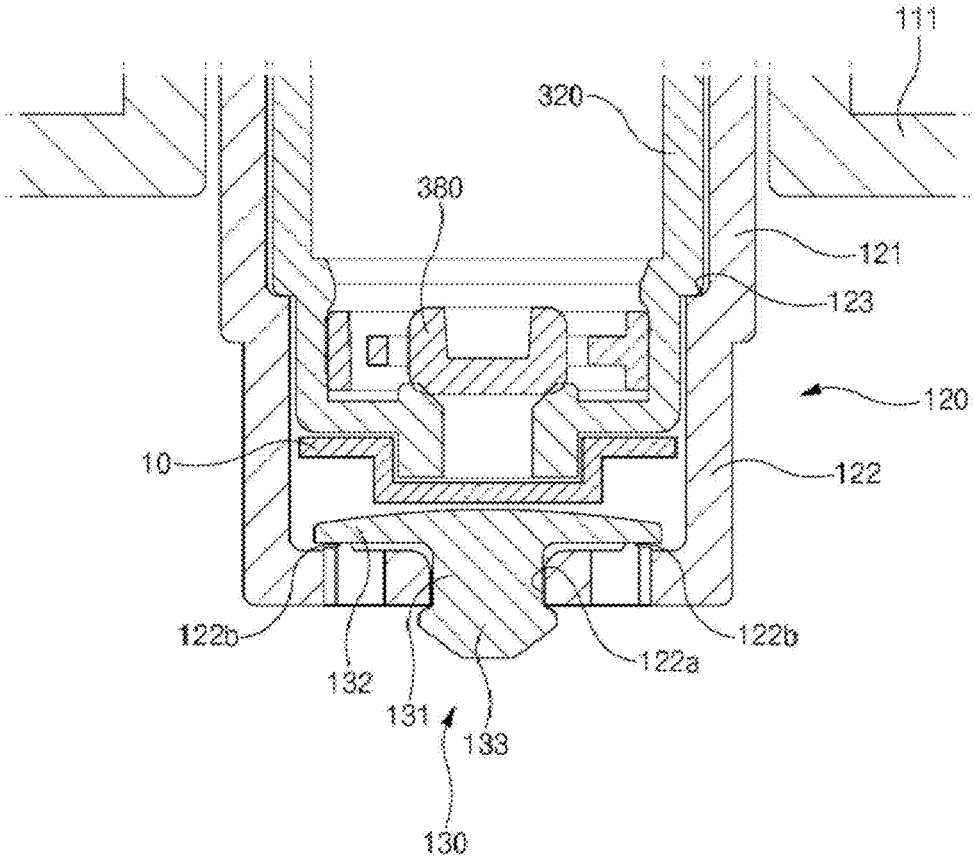
FIG. 6 is an enlarged view showing the region of a sealing member shown in FIG. 5.

FIG. 1 is a perspective view schematically showing a cosmetic refill container having an air block structure according to an embodiment of the present disclosure. FIG. 2 is a cross-sectional view of FIG. 1, FIG. 3 is an enlarged view of the area "A" shown in FIG. 2, FIGS. 4A and 4B are views showing that a refill cap of the cosmetic refill container shown in FIG. 2 is separated from a refill container body, FIG. 5 is a cross-sectional view showing a cosmetic container coupled with the cosmetic refill container shown in FIG. 2, FIG. 6 is an enlarged view showing the region of a sealing member shown in FIG. 5, and FIGS. 7A to 7E are use state views of this embodiment that show a process of separating and replacing a refill container coupled to a container main body with a new refill container.

As shown in the figures, a cosmetic refill container 100 having an air block structure according to this embodiment includes a refill container main body 110 storing a cosmetic preparation 10 therein and coupled to a container main body 200, a sealing coupling unit 120 coupled to the refill container main body 110 and provided as a discharge passage of the cosmetic preparation 10 stored in the refill container main body 110, and a sealing member 130 coupled to the sealing coupling unit 120 and preventing contact between the cosmetic preparation 10 stored in the refill container main body 110 and external air.

The refill container main body 110, as shown in FIG. 2, includes a refill container body 111, a refill cap 112 detachably coupled to the upper portion of the refill container body 111, a bottom cap 113 coupled to the lower portion of the refill container body 111 and sealing the lower portion of the refill container body 111, and a refill container piston 114 disposed in the refill container body 111 and guiding discharge of the cosmetic preparation 10.

The refill container body 111 of the refill container main body 110, as shown in FIG. 2, has a head 111*a* at the upper portion and threads 111*b* are formed on the outer wall of the head 111*a*, so the refill cap 112 can be detachably thread-fastened to the refill container main body 110.

In this embodiment, a step 111*c* is formed on the inner wall of the upper end of the refill container body 111, as shown in FIG. 2, thereby being able to support a coupling flange 121*a* of the sealing coupling unit 120.

Further, in this embodiment, a body expansion 111*d* is formed at the lower end of the outer wall of the refill container body 111, as shown in FIG. 2, thereby being able to support the bottom of the container main body 200, as shown in FIG. 5.

The refill cap 112 of the refill container body 111, as shown in FIG. 2, has cap threads 112*a*, so the cap threads 112*a* can be thread-fastened to the threads 111*b* formed on the head 111*a* of the refill container body 111.

In this embodiment, even though the refill cap 112 is separated from the head 111*a*, contact between external air and the cosmetic preparation 10 stored in the refill container body 111 can be prevented by the sealing member 130.

The sealing coupling unit 120, as shown in FIG. 2, is coupled to the head 111*a* of the refill container body 111, so it can be provided as a coupling place of the sealing member 130 and a discharge passage 341 of the cosmetic preparation 10. Further, in this embodiment, the sealing coupling unit 120, as shown in FIG. 5, can be provided as a seating place of a housing 320 of a pumping unit 300.

In this embodiment, the sealing coupling unit 120, as shown in FIG. 2, includes a first body 121 coupled to the head 111*a* of the refill container main body 110, a second body 122 formed at the lower portion of the first body 121 and having the sealing member 130 coupled thereto, and a supporting step 123 formed on the inner wall of the joint area between the first body 121 and the second body 122 and locking and supporting the housing 320 of the pumping unit 300.

The first body 121 of the sealing coupling unit 120, as shown in FIG. 2, may have a width larger than that of the second body 122.

In this embodiment, a coupling flange 121*a* is formed at the upper end of the first body 121, as shown in FIG. 2, and the coupling flange 121*a* can be locked and supported to the step 111*c* formed at the head 111*a*.

Figures 7A, 7B, 7C, 7D, 7E:
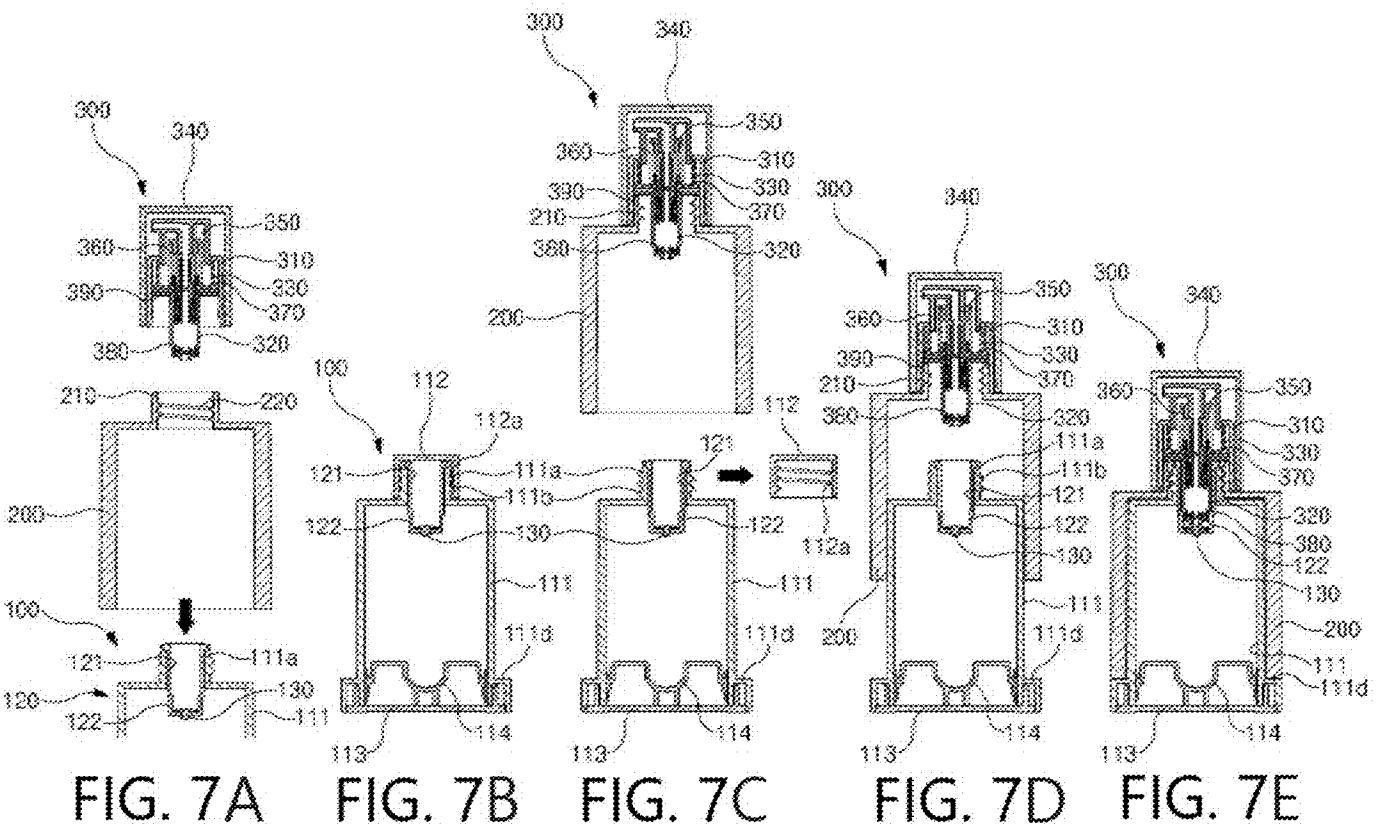
FIGS. 7A to 7E are use state views of this embodiment that show a process of separating and replacing a refill container coupled to a container main body with a new refill container.

A body hole 122*a* is formed at the second body 122 of the sealing coupling unit 120, as shown in FIG. 3, and the body hole 122*a* is closed by a sealing body 131 of the sealing member 130. As a result, as shown in FIG. 7C, even though the refill cap 112 is separated from the head 111*a*, it is possible to prevent contact between external air and the cosmetic preparation 10 stored in the refill container body 111. In this embodiment, the body hole 122*a* can be opened and provided as the discharge passage 341 of the cosmetic preparation 10 when the pumping unit 300 is operated.

In this embodiment, a supporting protrusion 122*b* is formed on the bottom inside the second body 122, as shown in FIG. 3, thereby being able to support a coupling flange 132 of the sealing member 130.

Further, in this embodiment, the cosmetic preparation 10 may stick to the inside of the second body 122, as shown in FIG. 6. That is, according to this embodiment, the cosmetic preparation 10 may stick only to the bottom of the housing 320 disposed in the lower area of the second body 122 in order to not only achieve the air block function of the refill container body 111 and minimize contamination in refilling.

The supporting step 123 of the sealing coupling unit 120, as shown in FIG. 3, may be formed on the inner wall of the joint area of the first body 121 and the second body 122.

In this embodiment, the lower portion of the housing 320 having a disc valve 380 can be locked and supported on the supporting step 123, as shown in FIG. 5.

The sealing member 130, as shown in FIG. 2, can seal the body hole 122*a* by being coupled to the body hole 122*a* of the second body 122, and can allow the cosmetic preparation 10 to be discharged through the body hole 122*a* when the pumping unit 300 is operated.

In this embodiment, the sealing member 130, as shown in FIG. 3, includes a sealing body 131 coupled to the body hole 122*a* formed at the sealing coupling unit 120, a sealing flange 132 formed at the sealing body 131 and covering the area over the body hole 122*a*, and a sealing expansion 133 formed at the sealing body 131 to protrude under the body hole 122*a* and preventing separation of the sealing body 131.

The sealing body 131 of the sealing unit 130, as shown in FIG. 3, has a size corresponding to the body hole 122*a* and closes the body hole 122*a* and opens the body hole 122*a* when the pumping unit 300 is operated, whereby the cosmetic preparation 10 can be discharged through the body hole 122*a*.

In this embodiment, the sealing body 131, the sealing flange 132, and the sealing expansion 133 may be integrated.

The sealing flange 132 of the sealing member 130, as shown in FIG. 3, may be disposed to cover the area over the body hole 122*a*.

In this embodiment, the edge of the sealing flange 132 may be supported on the supporting protrusion 122*b* so that the sealing flange 132 can be smoothly contracted and expanded up and down, as shown in FIG. 3.

The sealing expansion 133 of the sealing member 130, as shown in FIG. 3, has a size larger than that of the sealing body 131 and is exposed outside the second body 122, so it can be locked and supported to the bottom of the second body 122.

The container main body 200, as shown in FIG. 7A, can be provided as a place where the refill container 100 and the pumping unit 300 are detachably coupled.

In this embodiment, as shown in FIG. 5, a main body head 210 is formed at the upper portion of the container main body 200.

In this embodiment, main body threads 220 are formed on the inner wall of the main body head 210, as shown in FIG. 5, and the main body threads 220 can be thread-fastened to the head threads 111*b* of the refill container body 111.

The pumping unit 300 serves to discharge the cosmetic preparation 10 stored in the refill container body 111 to the outside from the refill container body 111 through the body hole 122*a* of the sealing coupling unit 120.

In this embodiment, the pumping unit 300, as shown in FIG. 5, includes: a pumping base body 310; a housing 320 coupled to the inner wall of the pumping base body 310 and having a lower portion locked and supported to the supporting step 123 of the sealing coupling unit 120; an elevation guide body 330 coupled to the pumping base body 310 and having a bottom supported on the top of the housing 320; a discharge cap 340 having an outer wall supported on the elevation guide body 330, having a discharge passage 341, and discharging the cosmetic preparation 10; a stem 350 having an upper portion coupled to the discharge cap 340 and moving up and down with the discharge cap 340; an elastic member 360 having a lower portion supported on the pumping base body 310 and an upper portion supporting the stem 350; a piston member 370 coupled to the lower portion of the stem 350 and disposed in the housing 320; a disc valve 380 disposed in the housing 320 and preventing backflow of the cosmetic preparation 10; a packing member 390 coupled to the pumping base body 310 to be disposed on the bottom of the upper portion of the housing 320; and a pumping cap 395 detachably coupled to the outer wall of the pumping base body 310.

The pumping base body 310 may be detachably coupled to the main body head 210 of the container main body 200 through fitting by a protrusion and a groove or through thread-fastening.

As described above, since this embodiment applies an air block structure, when the refill container is replaced, refilling is possible without contact between a cosmetic preparation and air, so it is possible to prevent rancidity or contamination of the cosmetic preparation.

The present disclosure is not limited to the embodiment described above and it is apparent to those skilled in the art that the present disclosure may be changed and modified in various ways without departing from the spirit and scope of the present disclosure. Accordingly, it should be noted that such changes and modifications are included in claims of the present disclosure.

DESCRIPTION OF REFERENCE NUMERALS

1: Cosmetic container
100: Cosmetic refill container
110: Refill container main body
111: Refill container body
111*a*: Head
111*b*: Upper portion and threads
111*c*: Step
112: Refill cap
112*a*: Cap threads
113: Bottom cap
114: Refill container piston
120: Sealing coupling unit
121: First body
121*a*: Coupling flange
122: Second body
122*a*: Body hole
122*b*: Supporting protrusion
123: Supporting step
130: Sealing member
131: Sealing body
132: Sealing flange
133: Sealing expansion
200: Container main body
210: Main body head
220: Main body threads
300: Pumping unit
310: Pumping base body
320: Housing
330: Elevation guide body
340: Discharge cap
341: Discharge passage
350: Stem
360: Elastic member
370: Piston member
380: Disc valve
390: Packing member
395: Pumping cap
10: Cosmetic preparation

What is claimed is:

1. A cosmetic refill container comprising:

a refill container main body configured to store a cosmetic preparation therein and coupled to a container main body;

a sealing coupling unit coupled to the refill container main body and provided as a discharge passage of the cosmetic preparation stored in the refill container main body; and a sealing member coupled to the sealing coupling unit and configured to prevent contact between the cosmetic preparation stored in the refill container main body and external air, wherein the sealing coupling unit includes:

a first body coupled to a head of the refill container main body; and a second body formed at a lower portion of the first body and having the sealing member coupled thereto.

2. The cosmetic refill container of claim 1, wherein the sealing coupling unit further includes a supporting step formed on an inner wall of a joint area between the first body and the second body and locking and supporting a housing of a pumping unit coupled to the container main body.

3. The cosmetic refill container of claim 1, wherein the sealing member includes:

a sealing body coupled to a body hole formed at the sealing coupling unit;

a sealing flange formed at the sealing body and configured to cover an area over the body hole; and a sealing expansion formed at the sealing body to protrude under the body hole and configured to prevent separation of the sealing body.

4. The cosmetic refill container of claim 3, wherein a supporting protrusion is formed on a bottom inside the second body of the sealing coupling unit, and a bottom of the sealing flange is supported on the supporting protrusion.

5. The cosmetic refill container of claim 1, wherein the refill container main body includes a refill container body having the sealing coupling unit coupled thereto, and a body expansion configured to support a bottom of the container main body is formed at the refill container main body.

6. The cosmetic refill container of claim 5, wherein the refill container main body: further includes a refill cap detachably coupled to the refill container body, and the refill cap is coupled to the refill container body with the sealing coupling unit coupled to the refill container body.

7. The cosmetic refill container of claim 1, wherein the refill container main body further includes a refill container piston disposed in the refill container body and configured to guide discharge of the cosmetic preparation.

8. A cosmetic container comprising:

a container main body;

a refill container coupled to the container main body and configured to store a cosmetic preparation; and a pumping unit coupled to the container main body and configured to pump the cosmetic preparation stored in the refill container to the outside of the refill container, wherein the refill container includes:

a refill container main body coupled to the container main body;

a sealing coupling unit coupled to the refill container main body and provided as a discharge passage of the cosmetic preparation stored in the refill container main body; and a sealing member coupled to the sealing coupling unit and configured to prevent contact between the cosmetic preparation stored in the refill container main body and external air, wherein the sealing coupling unit includes:

a first body coupled to a head of the refill container main body; and a second body formed at a lower portion of the first body and having the sealing member coupled thereto.

9. The cosmetic container of claim 8, wherein the sealing coupling unit further includes a supporting step formed on an inner wall of a joint area between the first body and the second body and locking and supporting a housing of a pumping unit coupled to the container main body.

10. The cosmetic container of claim 8, wherein the sealing member includes:

a sealing body coupled to a body hole formed at the sealing coupling unit;

a sealing flange formed at the sealing body and configured to cover an area over the body hole; and a sealing expansion formed at the sealing body to protrude under the body hole and configured to prevent separation of the sealing body.

11. The cosmetic container of claim 10, wherein a supporting protrusion is formed on a bottom inside the second body of the sealing coupling unit, and a bottom of the sealing flange is supported on the supporting protrusion.

12. The cosmetic container of claim 8, wherein the refill container main body includes a refill container body having the sealing coupling unit coupled thereto, and a body expansion configured to support a bottom of the container main body is formed at the refill container main body.

13. The cosmetic container of claim 12, wherein the refill container main body further includes a refill cap detachably coupled to the refill container body, and the refill cap is coupled to the refill container body with the sealing coupling unit coupled to the refill container body.

14. The cosmetic container of claim 8, wherein the refill container main body further includes a refill container piston disposed in the refill container body and configured to guide discharge of the cosmetic preparation.

* * * * *